US012782062B2

(12) United States Patent
Uhrig

(10) Patent No.: US 12,782,062 B2
(45) Date of Patent: Nov. 3, 2026

(54) HEAT EXCHANGER MODULE, HEAT EXCHANGER SYSTEM AND METHOD FOR PRODUCING THE HEAT EXCHANGER SYSTEM

(71) Applicant: UHRIG Energie GmbH, Geisingen (DE)

(72) Inventor: Thomas Uhrig, Geisingen (DE)

(73) Assignee: Uhrig Energie GmbH, Geisingen (DE)

( * ) Notice: Subject to any disclaimer, the term of this patent is extended or adjusted under 35 U.S.C. 154(b) by 335 days.

(21) Appl. No.: 17/603,734

(22) PCT Filed: Apr. 15, 2020

(86) PCT No.: PCT/EP2020/060527
§ 371 (c)(1),
(2) Date: Oct. 14, 2021

(87) PCT Pub. No.: WO2020/212383
PCT Pub. Date: Oct. 22, 2020

(65) Prior Publication Data

US 2022/0196342 A1 Jun. 23, 2022

(30) Foreign Application Priority Data

Apr. 15, 2019 (DE) ..... 10 2019 002 738.8

(51) Int. Cl.
*F28D 21/00* (2006.01)
*F28D 1/06* (2006.01)
*F28F 9/02* (2006.01)

(52) U.S. Cl.
CPC ..... *F28D 21/0012* (2013.01); *F28D 1/06* (2013.01); *F28F 9/027* (2013.01)

(58) Field of Classification Search
None
See application file for complete search history.

(56) References Cited

U.S. PATENT DOCUMENTS 1,883,057 A 10/1932 Stanyo
4,593,539 A * 6/1986 Humpolik ..... F25B 41/45 62/504

(Continued)

FOREIGN PATENT DOCUMENTS

AT 410111 B * 2/2003 ..... E03F 3/00
CA 2737359 A1 * 3/2010 ..... E03F 1/00

(Continued)

OTHER PUBLICATIONS

WO-2011080687-A2 English Machine Translation (Year: 2011).*

(Continued)

*Primary Examiner* — Jenna M Maroney
(74) *Attorney, Agent, or Firm* — Gerald E. Hespos; Michael J Porco

(57) ABSTRACT

A heat exchanger module (1) has a supply pipe portion (4) and a return pipe portion (6) that are connected fluidically to a heat exchanger chamber (2) of the heat exchanger module (1). The supply pipe portions (4) of a plurality of heat exchanger modules (1) can be interconnected fluidically to form a supply pipe (24), and the return pipe portions (6) of a plurality of heat exchanger modules (1) can be interconnected fluidically to form a return pipe portion (26). A feed pipe (12) is arranged inside the supply pipe portion (4), and a heat exchange fluid can be fed via the feed pipe (12) to the supply pipe portion (4).

8 Claims, 4 Drawing Sheets

(56) References Cited

U.S. PATENT DOCUMENTS

| | | | | |
|---|---|---|---|---|
| 8,752,614 | B2 | 6/2014 | Uhrig | |
| 9,528,778 | B2 * | 12/2016 | Liu | F28F 9/0268 |
| 9,581,397 | B2 | 2/2017 | Samuelson | |
| 10,001,325 | B2 | 6/2018 | Bergh | |
| 11,713,931 | B2 * | 8/2023 | Mercer | F25B 39/028 165/173 |
| 2007/0039724 | A1 * | 2/2007 | Trumbower | F28F 9/0273 62/515 |
| 2007/0163762 | A1 * | 7/2007 | Studer | F28F 19/002 165/134.1 |
| 2010/0282454 | A1 * | 11/2010 | Jiang | F28F 9/0273 165/175 |
| 2011/0127023 | A1 * | 6/2011 | Taras | F28F 9/0273 165/173 |
| 2011/0139422 | A1 * | 6/2011 | Oddi | F28F 9/027 165/173 |
| 2012/0186796 | A1 * | 7/2012 | Uhrig | F28F 19/00 29/890.03 |
| 2013/0020061 | A1 | 1/2013 | Bergh | |
| 2020/0003496 | A1 * | 1/2020 | MacKelvie | F28D 21/0012 |

FOREIGN PATENT DOCUMENTS

| | | | | |
|---|---|---|---|---|
| CA | 2947772 | A1 * | 5/2018 | F28D 1/06 |
| DE | 19719311 | A1 * | 12/1997 | E03F 3/00 |
| DE | 102004032180 | A1 * | 12/2005 | F24H 9/0036 |
| DE | 102007031084 | A1 * | 1/2009 | E03F 3/00 |
| DE | 10 2009 035 271 | | 8/2010 | |
| DE | 102009035271 | B3 * | 8/2010 | E03F 3/04 |
| DE | 10 2010 019 728 | | 11/2011 | |
| DE | 10 2014 223 394 | | 3/2016 | |
| DE | 102018003689 | A1 * | 10/2019 | F28D 1/0383 |
| DE | 102020003467 | A1 * | 12/2021 | F28D 21/0012 |
| FR | 2 954 819 | | 7/2011 | |
| FR | 2954819 | A1 * | 7/2011 | F28F 21/06 |
| JP | 60-251392 | | 12/1985 | |
| JP | 5967878 | B2 * | 8/2016 | |
| WO | WO-2005088208 | A1 * | 9/2005 | F24S 10/45 |
| WO | WO-2011012195 | A2 * | 2/2011 | E03F 3/04 |
| WO | WO-2011080687 | A2 * | 7/2011 | F28F 21/06 |
| WO | WO-2016023867 | A1 * | 2/2016 | F28F 21/062 |
| WO | WO-2017150993 | A1 * | 9/2017 | |
| WO | WO-2017157939 | A1 * | 9/2017 | |
| WO | WO-2018100300 | A1 * | 6/2018 | F25B 39/028 |
| WO | WO-2019201720 | A1 * | 10/2019 | F28D 1/0383 |
| WO | WO-2021249930 | A1 * | 12/2021 | F28D 21/0012 |

OTHER PUBLICATIONS

WO-2018100300-A1 English Machine Translation (Year: 2018).*
AT-410111-B English Machine Translation (Year: 2003).*
Wikipedia https://de.wikipedia.org/wiki/Tichelmann-System.
International Search Report of Aug. 11, 2020.

* cited by examiner

HEAT EXCHANGER MODULE, HEAT EXCHANGER SYSTEM AND METHOD FOR PRODUCING THE HEAT EXCHANGER SYSTEM

BACKGROUND

Field of the Invention

The invention relates to a heat exchanger module, a heat exchanger system, and a method for producing a heat exchanger system for, in particular retrospective, installation in a wastewater pipeline.

Related Art

Energy generation from wastewater by means of a heat exchanger installed retrospectively in the wastewater pipeline is known, for example, from U.S. Pat. No. 8,752,614.

In the case of the known heat exchanger, heat exchange fluid pipelines for inflow into and outflow out of the heat exchanger are attached underneath outflow surfaces, and thus are protected against contamination by the wastewater. This does not have any negative influence on the heat generation, since only the upper face of the known heat exchanger comes into contact with the wastewater.

Improved heat exchange could be achieved by also having a lower face of the heat exchanger come into contact with the wastewater. Incorporation of this improvement into the known heat exchanger would result in the pipelines for the inflow and outflow no longer being protected against contamination by the wastewater. Contamination of the pipelines for the inflow and outflow reduces heating of the heat exchange fluid in the pipeline for the outflow, since the pipeline for the outflow delivers some of the heat to the contamination on the outside of the pipeline, which withdraws the heat from the heat exchange fluid in the pipeline. In addition, the heat exchange fluid in the pipeline for the inflow is heated by contamination on the outside of the pipeline, as a result of which a temperature difference between the pipelines for the inflow and outflow is further reduced, and thus heat generation from the wastewater is further impaired. Furthermore, the pipelines around which fluid flows constitute a flow resistance, and thus impair the wastewater flow in the wastewater pipeline.

To overcome these disadvantages, an object of the present invention is to provide an improved heat exchanger module, heat exchanger system, and method for producing a heat exchanger system. A further object is to facilitate installing the heat exchanger modules to form a heat exchanger system.

SUMMARY

One aspect relates to a heat exchanger module, comprising a supply pipe portion and a return pipe portion that are connected fluidically to a heat exchanger chamber of the heat exchanger module. The supply pipe portions of a plurality of heat exchanger modules can be interconnected fluidically to form a supply pipe, and the return pipe portions of a plurality of heat exchanger modules can be interconnected fluidically to form a return pipe. A feed pipe can be or is arranged inside the supply pipe portion and can feed a heat exchange fluid to the supply pipe portion.

The invention advantageously provides a space-saving heat exchanger module that is suitable in particular for use in confined and/or restricted spaces, such as in a sewer.

Accordingly, better use can be made of the available space, such that the heat exchanger chamber can occupy more space in comparison with a conventional heat exchanger module in which a feed pipe is provided outside of the supply pipe portion. As a result, in the same space, a heat exchanger module having increased heat exchange capacity can be used.

A further advantage of the invention is that the heat exchanger module has a smaller cross-sectional area. The smaller cross-section ensures an improved wastewater flow and a reduced tendency to contamination of the heat exchanger module, in particular in the case of use in a sewer.

A further advantage of the invention is that the feed pipe, in particular possible connection points of a multi-part feed pipe, is protected better against contamination and/or damage.

The heat exchanger module can comprise at least one heat exchanger element having a heat exchanger chamber, and can be used for example for heat recovery from cold water from power stations, for storage of solar energy in hot water buffers, or also for heat recovery from waste heat, in particular from wastewater, from buildings, machines, or other facilities. Alternatively, or in addition to that described above, air or a gas or gas mixture can flow around the heat exchanger element, at least in portions.

A wastewater pipeline may be a pipeline for collecting and carrying wastewater. A wastewater flow direction may extend parallel to or coincident with the longitudinal direction of the wastewater pipeline. The wastewater flow direction generally is determined by a gradient of the wastewater pipeline and extends essentially parallel to the longitudinal direction described above or coincident therewith. Within the meaning of the present invention, a wastewater pipeline can also be an open wastewater gutter.

The supply pipe portion may be a portion of a supply pipe. The supply pipe portion and/or the supply pipe may be designed as a closed pipe or as an open gutter. Similarly, the return pipe portion and/or the return pipe may be designed as a closed pipe or as an open gutter.

The feed pipe may be designed as a closed pipe or as an open gutter, from where the heat exchange fluid can be or is fed to the supply pipe portion and/or the supply pipe, or to the return pipe portion and/or the return pipe. It is in principle described that the feed pipe is or can be arranged in the supply pipe portion and/or in the supply pipe. The advantages associated therewith can also be achieved if, alternatively thereto, the feed pipe can be or is arranged correspondingly in the return pipe portion and/or the return pipe.

As described above, the heat exchange fluid may be water, wastewater, air, a gas or a gas mixture.

Within the context of this description, the terms "upstream", "downstream" and the like are to be understood with respect to the flow direction of a medium described in this case, optionally in a pipe described in each case.

Within the meaning of the present invention, the applied terms "outer" or "inner" and the like mean that an, in particular idealized or imaginary, center point is an innermost point. An outer region with respect thereto is an, in particular idealized or imaginary, peripheral region that surrounds the center point, at least in part. Therefore, proceeding from the center point, in the radial direction, a point or region that is referred to as being located farther to the outside than another point or region is farther away, in the direction of the peripheral region, than the other point or region located farther to the inside.

Within the meaning of the present invention, the terms "above" or "over" and the like, which are used, mean a direction and/or a position of an element with respect to another element, counter to the direction of gravity. Within the meaning of the present invention, the terms "below" or "underneath" and the like, which are used in the following, mean a direction and/or a position of an element with respect to another element, in the direction of gravity.

Advantageously, a cross-sectional area of the supply pipe portion minus a cross-sectional area of the feed pipe can be approximately the same size as the cross-sectional area of the feed pipe. As a result, a flow resistance in the supply pipe portion can be kept approximately the same magnitude as a flow resistance in the feed pipe.

The feed pipe can in particular be formed in one piece. As a result, a leak-prone connection point of an otherwise multi-part feed pipe within the supply pipe portion can be avoided.

A fluid flow of the heat exchange fluid in the feed pipe can be directed counter to a fluid flow of the heat exchange fluid in the supply pipe portion.

In particular, the supply pipe portion can be fed with the heat exchange fluid at a downstream end of the feed pipe. In the case of this configuration, the heat exchange fluid passes through the entire feed pipe before it enters the supply pipe portion, from which the heat exchange fluid reaches the individual heat exchanger modules.

The feed pipe can be arrangeable or arranged concentrically in the supply pipe portion, in particular by means of guide rings and/or spacers.

Alternatively, an outside periphery of the feed pipe can touch an inside periphery of the supply pipe portion, at least in portions.

A concentric or eccentric position of the feed pipe with respect to the supply pipe portion can be achieved by means of guide rings and/or spacers that can be formed integrally on the feed pipe. As a result, introduction of the feed pipe into the supply pipe portion and/or maintenance of the desired position of the feed pipe in the supply pipe portion can be facilitated. In this case, it goes without saying that an outside geometry of the guide rings and/or spacers can be matched to an inside geometry of the supply pipe portion, and that an inside geometry of the guide rings and/or spacers can be matched to an outside geometry of the feed pipe.

The feed pipe may be formed of plastics material. As a result, increased durability and/or easier handling of the feed pipe, in particular when introducing the feed pipe into the supply pipe portion, can be ensured.

A further aspect relates to a heat exchanger system having a modular structure, comprising a plurality of heat exchanger modules that are arranged one behind the other. Each heat exchanger module comprises a supply pipe portion and a return pipe portion that are fluidically connected to a heat exchanger chamber of the heat exchanger module. The respective supply pipe portions of the individual heat exchanger modules are interconnected fluidically to form a supply pipe, and the respective return pipe portions of the individual heat exchanger modules are interconnected fluidically to form a return pipe. A feed pipe may be arranged inside the supply pipe, and a heat exchange fluid can be or is fed by the feed pipe to the supply pipe.

In addition to the advantages set out above for the heat exchanger module according to the invention, the heat exchanger system according to the invention is advantageous in that installation of the heat exchanger system is simplified, in particular on account of simplified introduction of the feed pipe into the supply pipe of already installed heat exchanger modules. In particular, as a result, separate connection of feed pipe portions, which are otherwise present per heat exchanger module, can be omitted.

In particular, the plurality of heat exchanger modules arranged one behind the other can be interconnected fluidically in parallel with one another. The heat exchanger modules arranged one behind the other can follow a course of the wastewater pipeline, in which they are installed for example.

A fluid flow of the heat exchange fluid in the feed pipe can be directed counter to a fluid flow of the heat exchange fluid in the supply pipe.

In particular, the supply pipe can be fed with the heat exchange fluid at a downstream end of the feed pipe. In the case of this configuration, the heat exchange fluid passes through the entire feed pipe before it enters the supply pipe, from which the heat exchange fluid reaches the individual heat exchanger modules.

A sum of the lengths of the feed pipe, supply pipe and return pipe in each heat exchanger module can be approximately the same. By way of this configuration, what is known as a Tichelmann system (Tichelmann pipe routing) can be implemented. In the case of the Tichelmann system, for example in a heating system the pipes are guided from the heat generator (e.g. heating boiler, solar installation) to the heat consumer (e.g. radiator, hot water tank), and back, in an annular installation, such that the sum of the lengths of the flow portion and return portion in each radiator is approximately the same. Radiators having a short flow portion have a long return portion, and vice versa. In this case, the intention is for all the radiators to be subjected to approximately identical pressure losses, and thus for equal volume flows=equal heat flows to be established in the radiators, even if no control valves are used. This brings about uniform heating, even of radiators located farther away. A connection according to "Tichelmann" also means that the zeta values (pressure loss coefficients) of the shaped pieces of the pipeline for connection of a plurality of identical components (generally hot water tanks or solar collectors) are identical in sum per individual component, in order that a uniform through-flow is ensured (Source: Wikipedia https://de.wikipedia.org/wiki/Tichelmann-System).

In particular, a cross-sectional area of the supply pipe minus a cross-sectional area of the feed pipe can be approximately the same size as the cross-sectional area of the feed pipe. As a result, a flow resistance in the supply pipe can be kept approximately the same magnitude as a flow resistance in the feed pipe.

The feed pipe can advantageously be formed in one piece. As a result, a leak-prone connection point of an otherwise multi-part feed pipe within the supply pipe can be avoided. Furthermore, this configuration makes it possible to further simplify the installation of the heat exchanger system, since the introduction of the one-piece feed pipe into the supply pipe of the already installed heat exchanger modules means a significant simplification, in particular if the feed pipe is quasi endless, i.e. is provided for example in the form of a 100 m roll. In particular, as a result, separate connection of feed pipe portions which are otherwise present per heat exchanger module can be omitted.

The feed pipe can be arranged concentrically in the supply pipe by means of guide rings and/or spacers.

Alternatively thereto, an outside periphery of the feed pipe can touch an inside periphery of the supply pipe, at least in portions.

A concentric or eccentric position of the feed pipe with respect to the supply pipe can be achieved by means of guide rings and/or spacers that can be formed integrally on the feed pipe. As a result, introduction of the feed pipe into the supply pipe and/or maintenance of the desired position of the feed pipe in the supply pipe can be facilitated. In this case, it goes without saying that an outside geometry of the guide rings and/or spacers is matched to an inside geometry of the supply pipe, and that an inside geometry of the guide rings and/or spacers is matched to an outside geometry of the feed pipe.

The feed pipe may be formed of plastics material. As a result, increased durability and/or easier handling of the feed pipe, in particular when introducing the feed pipe into the supply pipe, can be ensured.

A further aspect relates to a method for producing a heat exchanger system having a modular construction. The method comprises the steps of: arranging a plurality of heat exchanger modules one behind the other, providing a supply pipe portion and a return pipe portion at each heat exchanger module, and fluidically connecting the supply pipe portion and the return pipe portion to a heat exchanger chamber of the heat exchanger module, fluidically interconnecting the respective supply pipe portions of the individual heat exchanger modules to form a supply pipe, and fluidically interconnecting the respective return pipe portions of the individual heat exchanger modules to form a return pipe, and arranging a feed pipe inside the supply pipe in order to feed a heat exchange fluid to the supply pipe.

The advantages of the method for producing the heat exchanger system follow analogously from the features, and the advantages thereof, cited with respect to the above-mentioned heat exchanger module and with respect to the heat exchanger system.

The method described above applies correspondingly for the case of just one single heat exchanger module.

In the following, exemplary embodiments of the heat exchanger module according to the invention and of the heat exchanger system are explained in greater detail, with reference to drawings. Of course, the present invention is not limited to the exemplary embodiments described below, and individual features thereof can be combined to form further exemplary embodiments.

BRIEF DESCRIPTION OF THE DRAWINGS

FIG. 1A is a three-dimensional view of a heat exchanger module according to an embodiment of the invention where the feed pipe is arranged concentrically in the supply pipe, whereas

DETAILED DESCRIPTION

Figure 1A:
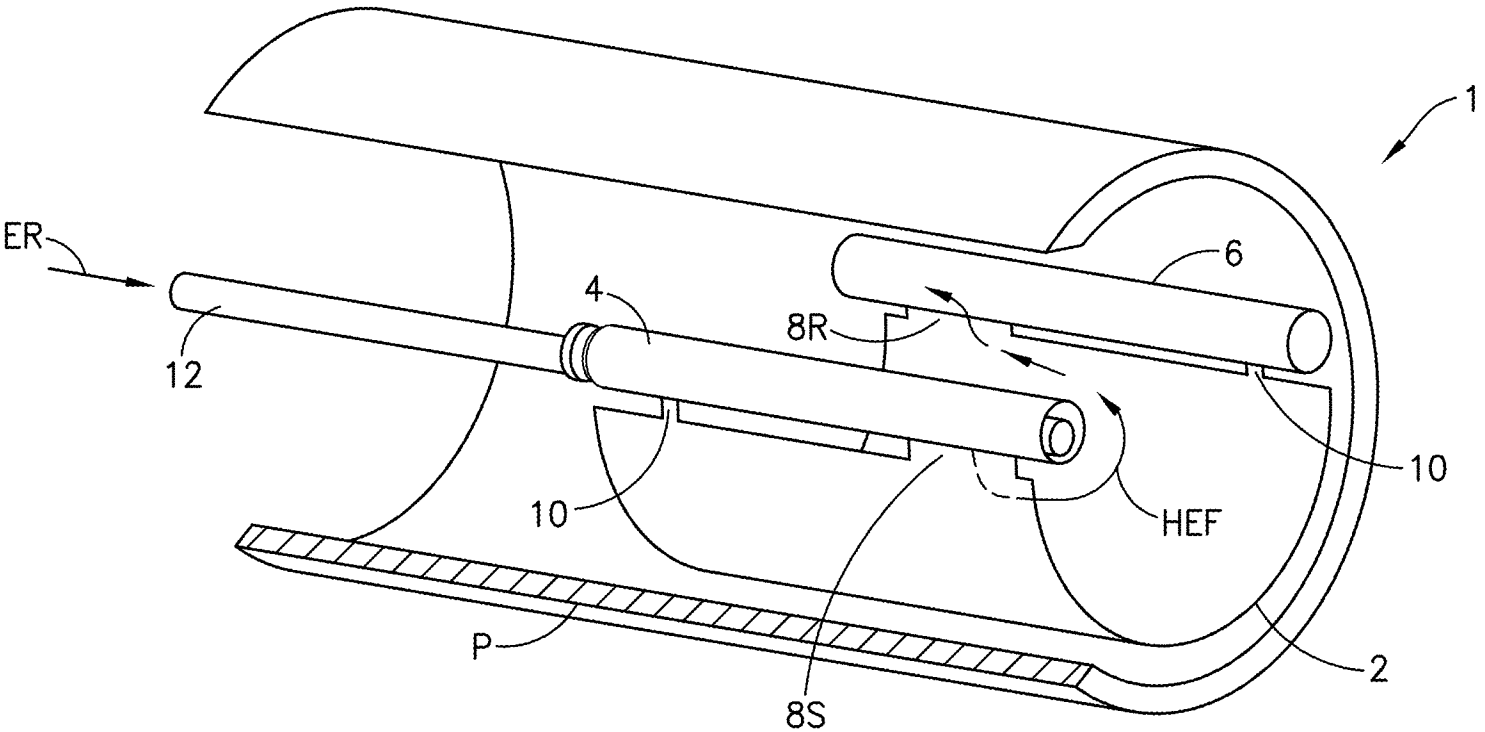
Figure 1B:
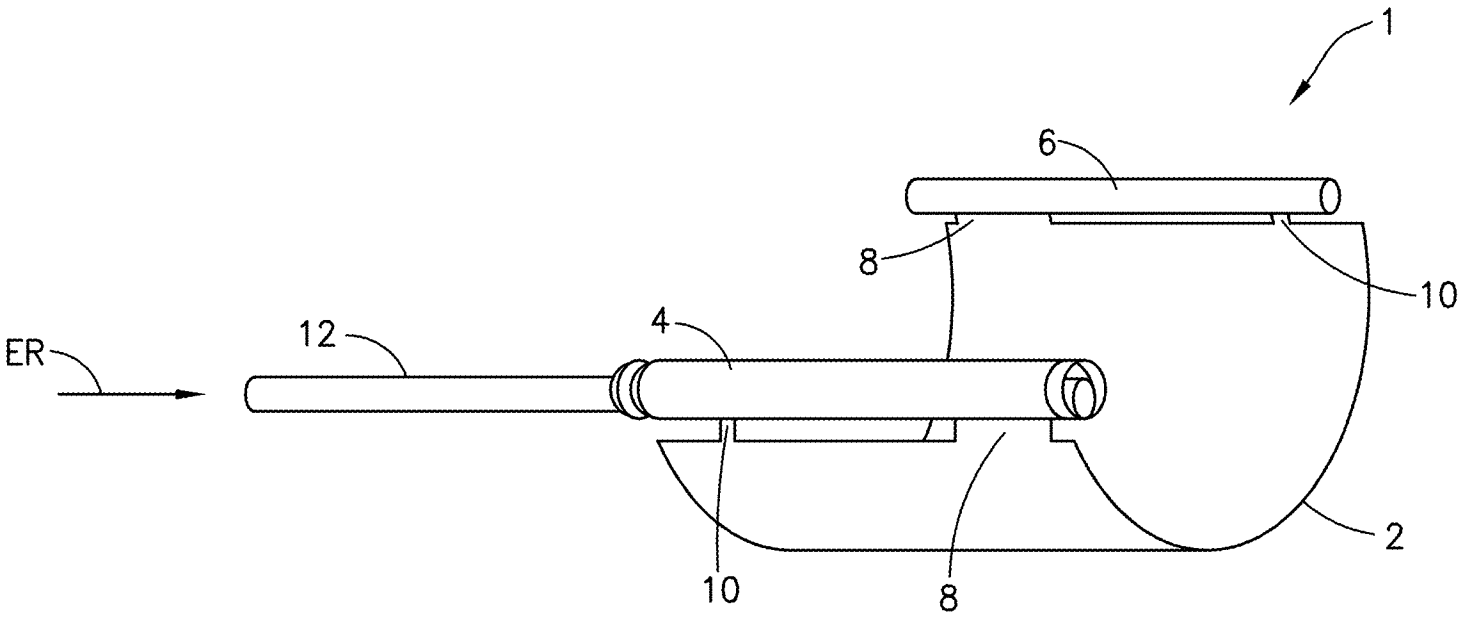
FIG. 1B shows an embodiment where the feedpipe touches an interior of the supply pipe.

FIGS. 1A and 1B are three-dimensional views of a heat exchanger module 1 according to an exemplary embodiment of the invention. The heat exchanger module 1 can be disposed in a wastewater pipe P to withdraw heat from wastewater in the wastewater pipe P. More particularly, the heat exchanger module 1 comprises a heat exchanger element having a heat exchanger chamber 2 at which a supply pipe portion 4 and a return pipe portion 6 are fluidically connected to the heat exchanger chamber 2 at a supply connection port 8S and a return connection port 8R respectively. According to an exemplary embodiment that is not shown in FIGS. 1A and 1B, but is shown schematically in FIG. 3, the heat exchanger module 1 can comprise a plurality of heat exchanger elements that are fluidically interconnected at respective upstream and downstream ends. For reasons of stability, the supply pipe portion 4 and the return pipe portion 6 can additionally be mechanically connected to the heat exchanger chamber 2 at a bracing point 10.

A feed pipe 12 is arranged in the supply pipe portion 4, and a heat exchange fluid can be introduced into the feed pipe 12 in an introduction direction ER. In FIG. 1A. the feed pipe 12 is arranged concentrically in the supply pipe portion 4. whereas in FIG. 1B, the feed pipe 12 touches an interior of the supply pipe portion 4. In FIG. 1, the feed pipe 12 is shown protruding from the supply pipe portion 4 counter to the introduction direction ER, as is the case for example when introducing the feed pipe 12 into the supply pipe portion 4. At the downstream end thereof, viewed in the introduction direction ER, the supply pipe portion 4 is formed to be open, just like the feed pipe 12, in particular for connection of a further heat exchanger module 1.

If the heat exchanger module 1 is intended to be operated alone, i.e. is not intended to be connected to a second heat exchanger module 1 arranged therebehind for example, the supply pipe portion 4 can be formed to be closed at the downstream end, viewed in the introduction direction ER. In contrast, in this case too, the feed pipe 12 remains open at the downstream end thereof, viewed in the introduction direction ER. Advantageously, the downstream end of the feed pipe 12, viewed in the introduction direction ER, is spaced apart from the downstream end of the supply pipe portion 4, viewed in the introduction direction ER, counter to the introduction direction ER. This configuration allows a more effective entry of the heat exchange fluid from the feed pipe 12 into the supply pipe portion 4.

In the supply pipe portion 4, the heat exchange fluid flows in a flow direction ZR, which is directed counter to the introduction direction ER, and enters the heat exchanger chamber 2 via the connection port 8. The heat exchanger chamber 2, which is for example heated by wastewater flowing therearound, heats the heat exchange fluid that enters the return pipe portion 6 via the other connection port 8. From there, the heated heat exchange fluid can be conveyed for example into a radiator (not shown) or the like, after which it is delivered back into the feed pipe 12 for example by a pump (not shown), in order to close the circuit.

Figure 2:
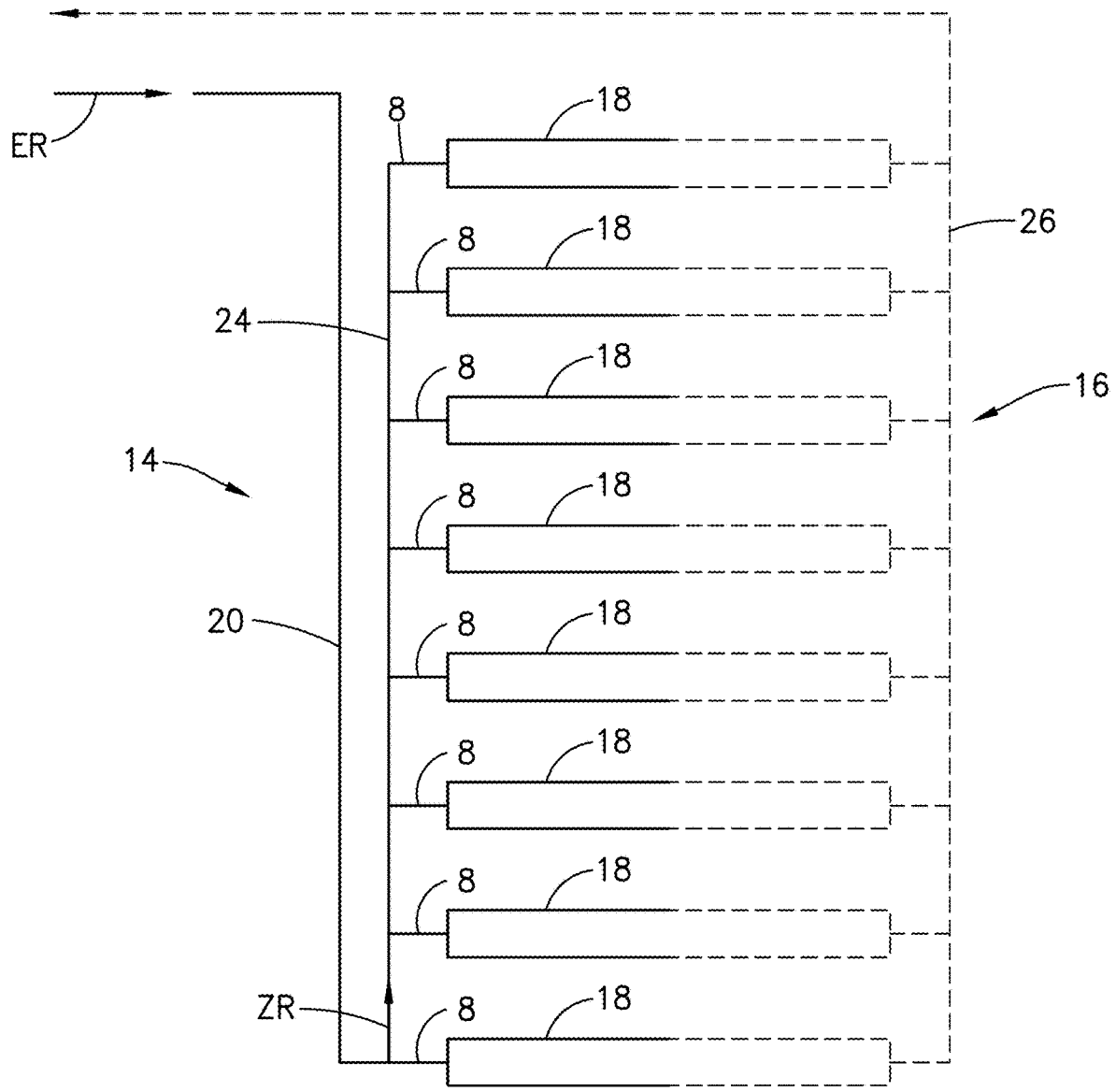
FIG.2 PRIOR ART
FIG. 2 is a schematic diagram of the known Tichelmann system.

FIG. 2 is a schematic illustration of a known Tichelmann system, taking the example of solar collectors 18 which are connected in parallel.

In the case of the Tichelmann system (Tichelmann pipe routing) in a heating system the pipes are typically guided from the heat generator (e.g. heating boiler, solar installation comprising solar collectors 18) to the heat consumer (e.g. radiator, hot water tank), and back, in an annular installation, such that the sum of the lengths of the flow portion 14 and return portion 16 in each solar collector 18 is approximately the same. Solar collectors 18 having a short flow portion 14 have a long return portion 16, and vice versa. In this case, the intention is for all the solar collectors 18 to be subjected to approximately identical pressure losses, and thus for equal volume flows=equal heat flows to be established therein, even if no control valves are used. This brings about uniform heating of a heat exchange fluid, even in the case of solar collectors 18 located further away. A connection according to "Tichelmann" also means that the zeta values (pressure loss coefficients) of the shaped pieces of the pipeline for connection of a plurality of identical components (generally hot water tanks or solar collectors 18) are identical in sum per individual component, in order that a uniform through-flow is ensured (Source: Wikipedia https://de.wikipedia.org/wiki/Tichelmann-System).

The colder flow portion 14 is indicated by solid lines, and the hotter return portion 16 is indicated by lines consisting of a dash and two dots. A heat exchange fluid pump and a heat consumer (e.g. radiator, hot water tank) for using the heat in the return portion 16 are omitted. Cold heat exchange fluid is introduced into the flow portion 14 in the introduction direction ER. Viewed in the introduction direction ER, the flow portion 14 comprises what is known as a Tichelmann pipe 20, upstream of the supply pipe 24 comprising the connection ports 8 for connection to the solar collectors 18. The Tichelmann pipe 20 is designed as an extension of the supply pipe 24 and is formed in parallel therewith. As a result of this arrangement, the heat exchange fluid flows in a flow direction ZR in the supply pipe 24, which direction is counter to the introduction direction ER, although a fluid flow in the flow portion 14 is not reversed, i.e. always flows in the same direction. From the supply pipe 24, the heat exchange fluid reaches the relevant heat exchanger module 1 and the heat exchanger chamber 2 thereof, via the relevant connection port 8. The heated heat exchange fluid is returned to the circuit via the return pipe 26.

The Tichelmann pipe 20 ensures that the path of the heat exchange fluid in the flow portion 14 is lengthened, and thus the sum of the lengths of the flow portion 14 and return portion 16 in each solar collector 18 is approximately the same.

Figure 3:
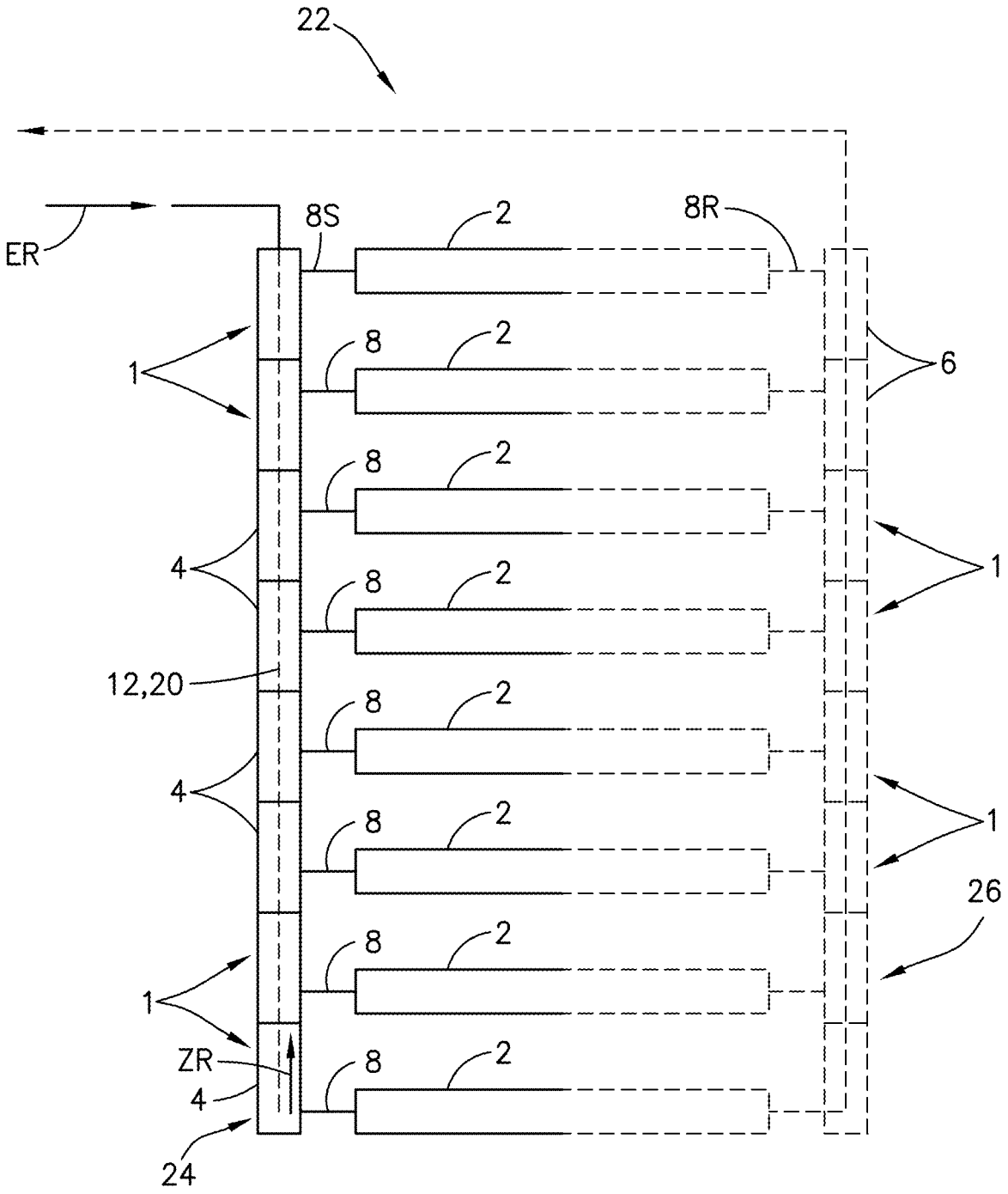
FIG. 3 is a schematic diagram of a heat exchanger system according to the invention comprising heat exchanger modules, according to FIG. 1, connected in parallel.

In the case of the heat exchanger system 22 shown in FIG. 3, a plurality of heat exchanger modules 1 according to FIG. 1 are connected, in a parallel connection, to what is known as the "Tichelmann pipe" 20, as a result of which an infeed pressure of the heat exchange fluid into the heat exchanger modules 1 can be kept at approximately the same magnitude in each case, without providing control valves, as already mentioned above. As is also already mentioned, this ensures a uniform through-flow and thus a uniform heat transfer from the wastewater to the heat exchange fluid in the individual heat exchanger modules 1.

The feed pipe 12, shown dashed, is designed as a Tichelmann pipe 20 and is arranged inside the supply pipe 24. The heat exchange fluid must pass through the entire feed pipe 12 before it exits the feed pipe 12 at a downstream end of the feed pipe 12, viewed in the introduction direction ER of the heat exchange fluid, and thus feeds the supply pipe 24.

In the supply pipe 24, the heat exchange fluid HEF flows in the flow direction ZR and enters the relevant heat exchanger module 1 of the heat exchanger system 22 via the relevant supply connection port 8S, and subsequently back again, via the return connection port 8R and the return pipe 26, for example to a heat exchange fluid pump (not shown), to the outlet of which the supply pipe 24 is connected.

In this case, the flow direction ZR of the heat exchange fluid in the supply pipe 24 is directed counter to the introduction direction ER of the heat exchange fluid in the feed pipe 12, i.e. inside the flow portion 14 the flow direction of the heat exchange fluid is reversed.

LIST OF REFERENCE CHARACTERS

1 heat exchanger module
2 heat exchanger chamber
4 supply pipe portion
6 return pipe portion
8 connection port
10 bracing point
12 feed pipe
14 flow portion
16 return portion
18 solar collector
20 Tichelmann pipe
22 heat exchanger system
24 supply pipe
26 return pipe
ER introduction direction
ZR flow direction

The invention claimed is:

1. A heat exchanger system (22) having a modular construction, comprising:

a wastewater pipeline (P) extending in a longitudinal direction and carrying wastewater;

a plurality of heat exchanger modules (1) arranged in the wastewater pipeline (P) and disposed one behind the other in along the longitudinal direction of the wastewater pipeline (P), each of the heat exchanger modules (1) comprising a supply pipe portion (4) having at least one supply connection port (8S), a return pipe portion (6) having at least one return connection port (8R) and a heat exchanger chamber (2) that fluidically connects the at least one supply connection port (8S) of the supply pipe portion (4) to the at least one return connection port (8R) of the return pipe portion (6), the respective supply pipe portions (4) of the individual heat exchanger modules (1) being interconnected fluidically so that a downstream end of one of the supply pipe portions (4) is interconnected fluidically to an upstream end of another one of the supply pipe portions (4) to form a supply pipe (24), and the respective return pipe portions (6) of the individual heat exchanger modules (1) being interconnected fluidically so that a downstream end of one of the return pipe portions (6) is interconnected fluidically to an upstream end of another one of the return pipe portions (6) to form a return pipe (26), and a feed pipe (12) formed as one piece, and the one piece that forms the feed pipe being arranged to extend inside the interconnected supply pipe portions that form the supply pipe (24), the feed pipe (12) carrying a heat exchange fluid through the entire feed pipe (12) and into the supply pipe (24) at a downstream end of the feed pipe (12) so that the heat exchange fluid can flow from the supply connection ports (8S) of the supply pipe (24) to the return connection ports (8R) of the return pipe (26) via the heat exchanger chamber (2), and wherein the heat exchanger chambers (2) of the heat exchanger modules (1) carryout heat exchange between the wastewater in the wastewater pipeline (P) and the heat exchange fluid passing between the supply connection ports (8S) of the supply pipe (24) and the return connection ports (8R) of the return pipe (26).

2. The heat exchanger system (22) of claim 1, wherein a fluid flow of the heat exchange fluid in the feed pipe (12) is directed counter to a fluid flow of the heat exchange fluid in the supply pipe (24).

3. The heat exchanger system (22) of claim 1, wherein the supply pipe (24) is fed with the heat exchange fluid at a downstream end of the feed pipe (12).

4. The heat exchanger system (22) of claim 1, wherein a sum of the lengths of the feed pipe (12), the supply pipe (24) and the return pipe (26) in each heat exchanger module (1) is the same.

5. The heat exchanger system (22) of claim 1, wherein a cross-sectional area of the supply pipe (24) minus a cross-sectional area of the feed pipe (12) is the same size as the cross-sectional area of the feed pipe (12).

6. The heat exchanger system (22) of claim 1, wherein the feed pipe (12) is formed of plastics material.

7. A method for producing a heat exchanger system (22) having a modular construction and configured for withdrawing heat from wastewater in a wastewater pipeline (P), comprising the steps of:

arranging a plurality of heat exchanger modules (1) one behind another, each of the heat exchanger modules (1) having a heat exchanger chamber (2), a supply pipe portion (4) having a supply connection port (8S) providing fluid communication from the supply pipe portion (4) to the heat exchanger chamber (2) and a return pipe portion (6) extending parallel to the supply pipe portion (4) and having a return connection port (8R) providing fluid communication from the heat exchanger chamber (2) to the return pipe portion (6) at each heat exchanger module (1), fluidically interconnecting the respective supply pipe portions (4) of the individual heat exchanger modules (1) so that a downstream end of one of the supply pipe portions (4) is interconnected fluidically to an upstream end of another one of the supply pipe portions (4) to form a supply pipe (24), and fluidically interconnecting the respective return pipe portions (6) of the individual heat exchanger modules (1) so that a downstream end of one of the return pipe portions (6) is interconnected fluidically to an upstream end of another one of the return pipe portions (6) to form a return pipe (26), introducing the heat exchanger modules (1) into the wastewater pipeline (P), and introducing a one-piece feed pipe (12) into the fluidically interconnected supply pipe portions (4) of the supply pipe (24) after the heat exchanger modules (1) have been introduced into the wastewater pipeline (P) so that a heat exchange fluid passes through the entire feed pipe (12) before entering the supply pipe (24) at a downstream end of the feed pipe (12).

8. The heat exchanger system (22) of claim 1, wherein the feed pipe (12) is formed of a plastic material.

* * * * *